US005347248A

United States Patent [19]

Herbert

[11] Patent Number: 5,347,248

[45] Date of Patent: Sep. 13, 1994

[54] PROTECTIVE SWITCHING DEVICE FOR DIFFERENCE-CURRENT AND UNDERVOLTAGE TRIPPING

[75] Inventor: Franz Herbert, Alzenau, Fed. Rep. of Germany

[73] Assignee: Heinrich Kopp AG, Kahl am Main, Fed. Rep. of Germany

[21] Appl. No.: 940,889

[22] PCT Filed: Jan. 25, 1992

[86] PCT No.: PCT/DE92/00053

§ 371 Date: Oct. 15, 1992

§ 102(e) Date: Oct. 15, 1992

[87] PCT Pub. No.: WO92/15110

PCT Pub. Date: Sep. 3, 1992

[30] Foreign Application Priority Data

Feb. 19, 1991 [DE] Fed. Rep. of Germany ..... 4105040

[51] Int. Cl.[5] ..... H01H 73/00

[52] U.S. Cl. ..... 335/18; 335/185; 335/190

[58] Field of Search ..... 335/18, 19, 20, 14, 335/131, 132, 202; 361/42-50

[56] References Cited

U.S. PATENT DOCUMENTS

| | | | |
|---|---|---|---|
| 4,010,432 | 3/1977 | Klein et al. . | |
| 4,209,762 | 6/1980 | Samborski et al. . | |
| 4,774,484 | 9/1988 | Lehman et al. | 335/132 |
| 5,148,344 | 9/1992 | Rao et al. | 335/18 |

FOREIGN PATENT DOCUMENTS

| | | |
|---|---|---|
| 189493 | 8/1986 | European Pat. Off. . |
| 202162 | 11/1986 | European Pat. Off. . |
| 1137114 | 9/1962 | Fed. Rep. of Germany . |
| 85/02724 | 6/1985 | PCT Int'l Appl. . |
| 2141587 | 12/1984 | United Kingdom . |
| 2169749 | 6/1986 | United Kingdom . |

*Primary Examiner*—Lincoln Donovan
*Attorney, Agent, or Firm*—Collard & Roe

[57] ABSTRACT

A protective switching device with difference-current, undervoltage and free tripping in a confined space, for example within a conventional mains angle plug or the like, the switch-on and plunger-type magnet mechanics and the electronic monitoring arrangement are divided per se in constructional groups capable of being assembled efficiently.

10 Claims, 6 Drawing Sheets

PROTECTIVE SWITCHING DEVICE FOR DIFFERENCE-CURRENT AND UNDERVOLTAGE TRIPPING

BACKGROUND OF THE INVENTION

1. Field of the Invention

The invention relates to a protective switching device for difference-current and undervoltage tripping of the built-in and mobile type. The device includes a contact arrangement that can be switched on mechanically by hand and triggered electromagnetically.

2. The Prior Art

It is known that such protective switching devices are connected as series devices within consumer products via one or several sensor line(s) with additional electrodes. This requires a special connection cable between the two parts and leads to triggering only if current leakage flows through the sensor line(s). In most cases, the devices do not have undervoltage and free triggering, and do not provide for testing their functionality.

However, a leakage-current protective switching device embodied as a connection plug for an electrical consumer product is known from EP 0 189 493 B1, which device contains a switch contact arrangement that has to be actuated all-pole by hand by means of a push-button via a switching mechanism, and which can be tripped electromagnetically by an electronic difference-current and low-voltage monitoring device. In addition, the device has a tester for controlling its functionality.

The known series device, however, makes use of a relatively complicated switch-on and tripping mechanism and, accordingly, has to be manufactured and installed in a costly way. In addition, the constructional structure of the device requires a special casing.

SUMMARY OF THE INVENTION

The invention is based on the problem of arranging such a protective switching device in individual assemblies and assembling it in a confined space to an efficient built-in installation unit.

For resolving said problem, the switching mechanism of a protective switching device is based on a coupling member, that is adjustable in a defined way on the operator's side, between a fixed stop of the casing and a pressure-spring loaded plunger-type magnet of the electromagnetic tripping element acting on a contact support. The tripping element is adjustable pressure-spring loaded in the opposite direction, through an idle-stroke or release profile corresponding with said contact support.

With the embodiment according to the invention of the switching mechanism—which has to be actuated manually and electromagnetically—for the electrical contact arrangement of the protective switching device, one obtains in a progressive way an assembly of individual parts that is independent per se and fully efficient. The individual parts can be associated with other parts of the device, which are combined in assemblies in the same way, within close limits, so as to be able to install the assemblies in a small casing, or in the respective empty space within any desired electrical appliance.

According to a further embodiment, the coupling member is a two-arm rocking lever supported for swinging around a shaft in the extensions of the control handle, which extensions support themselves against a screw pressure spring on the casing. The coupling member is, in the direction of actuation, provided with a stop bow elastically molded onto it, and, in the opposite direction, has above the point of rotary support a recess matching the cross section of the contact support. The switch-on and tripping mechanics are combined with the contact support to one structural part, of which the casing supports the electromagnetic plunger-type magnet system laterally beneath the projectingly active lever arm of the coupling member.

Concerning the electronic system of the protective switching device, the latter is arranged together with the fixed contact pieces of the switching track, an auxiliary contact arrangement for the power supply of the device, and the test key contacts arranged on a printed circuit board. The circuit board, as a further constructional part, is assembled with the afore-specified switch-on and tripping mechanics, and can be joined by soldering with the connections of the exciting winding of the electromagnetic plunger-type magnet system. If the assembled constructional parts are built, for example into the casing of a conventional connection plug and provided with a cover, the control handles of the protective switching device may extend through the cover. The circuit board may be arranged on top of the switching mechanics within the plug casing, by soldering it to the upwardly extending connection tags of the prongs of the plug.

BRIEF DESCRIPTION OF THE DRAWINGS

In the drawing attached hereto, the protective switching device for the consumer product connected via a cable is built into a contoured angle plug, and is shown as an exemplified embodiment of the invention. In the drawings.

FIG. 2 shows a part from FIG. 1 with the control handle completely pressed in;

DETAILED DESCRIPTION OF THE PREFERRED EMBODIMENT

Figure 1:
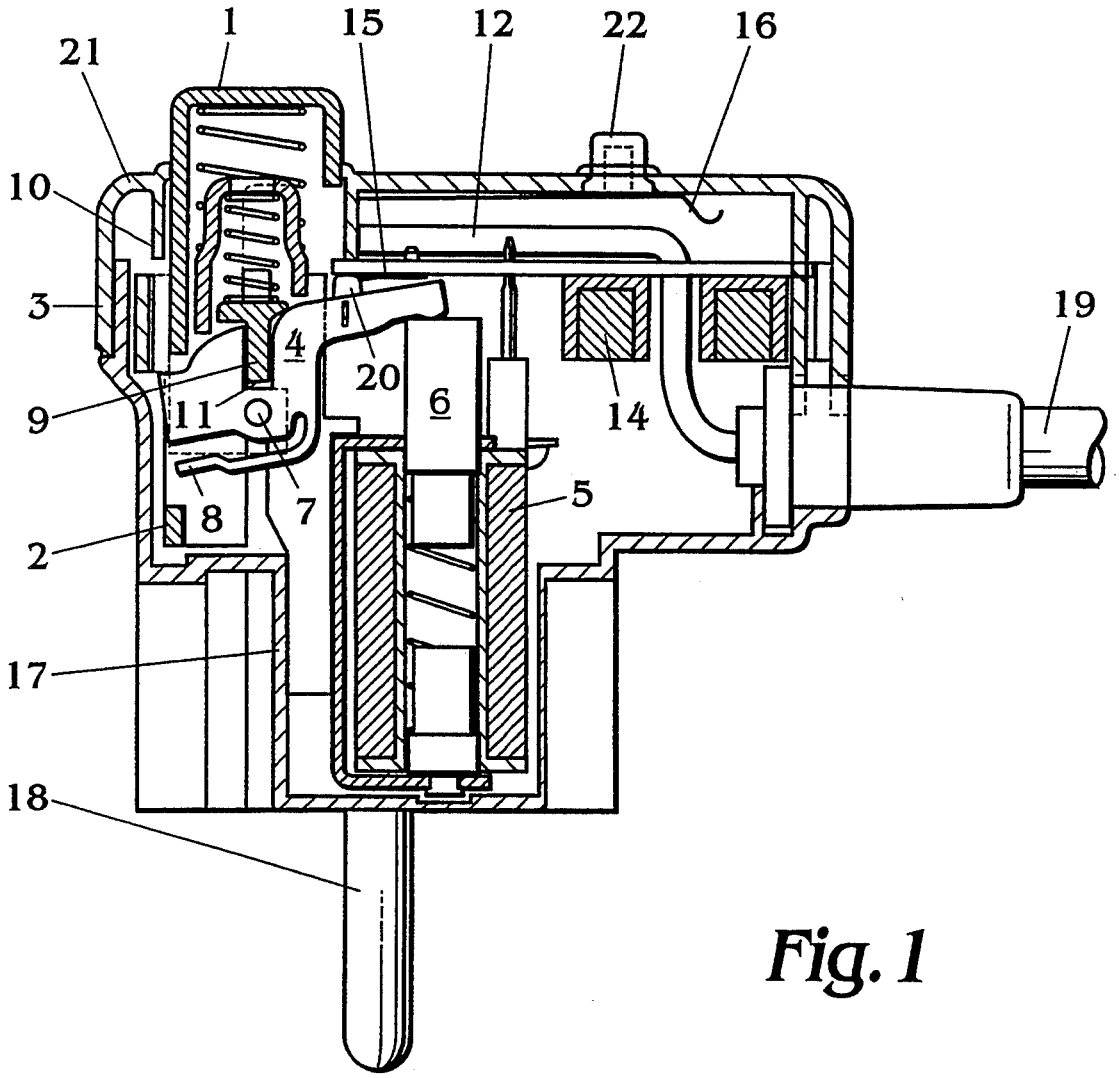
FIG. 1 shows a longitudinal section through the bipolar device in the switch-off position.

The schematic view in FIG. 1 of the drawing shows that the switching mechanics of the bipolar protective switching device, which is actuated manually with a pressure-spring-loaded control handle 1. Handle 1 acts on the plunger 6 of the electromagnetic tripping element via the coupling element 4 elastically supported on a fixed stop 2 of the casing part 3, on the one hand, and on the plunger 6 immersing against spring force in the excitation coil 5, on the other hand. In this connection, the coupling element 4, which is adjustable with the control handle 1, is swivel-mounted on two downwardly extending extensions of said handle, swinging around a shaft 7. In its direction of actuation, the coupling element 4 is provided with a stop bow molded onto it as an elastic element. For latching with the support part 9 for the movable contact pieces 10, said support part 9 being adjustable pressure-spring-loaded in the direction opposite the direction of switch-on actuation. The adjustable and swivelling coupling element 4 is provided on the "relief side" with a curved profile, in the conforming recess 11 of which profile the support part 9 can engage when the coupling element 4 is in the non-swivelled condition. Swivelling coupling element 4 up against the stop 2, with the plunger system excited according to the representation in FIGS. 2 and 3 of the drawing, leads to latching beneath the contact support part 9 with manual release of the control handle 1 support part 9 and its contact pieces 10 is adjusted against the fixed contact pieces 13 arranged on the underside of the printed circuit board 12.

Figure 5:
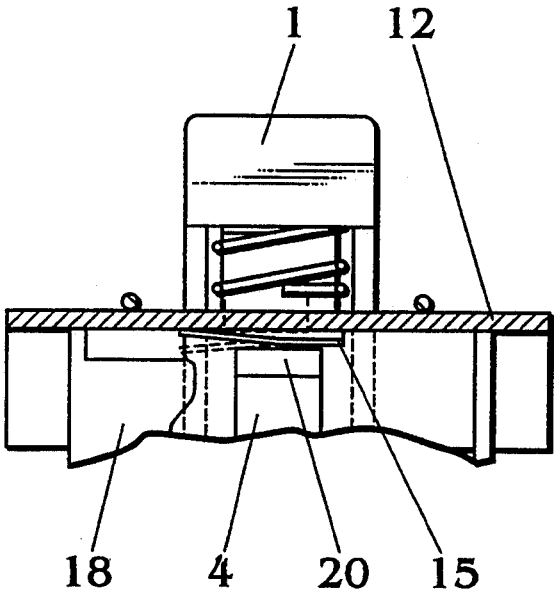
FIG. 5 is a part view of the auxiliary contact arrangement for the power supply of the electronics.

As another constructional part of the protective switching device, the circuit board 12, furthermore, supports the electronics required for difference-current monitoring, such as the summation transformer 14, an auxiliary contact arrangement 15 and a test contact arrangement 16. Auxiliary contact arrangement 15 (according to FIG. 5) provides the power supply for the protective switching device. Auxiliary contact arrangement 15 is closed in the course of switch-on actuation by the coupling element 4 of the switching mechanics. Test contact arrangement 16, which has to be actuated from the outside is for checking the functionality of the protective switching device.

Figure 4:
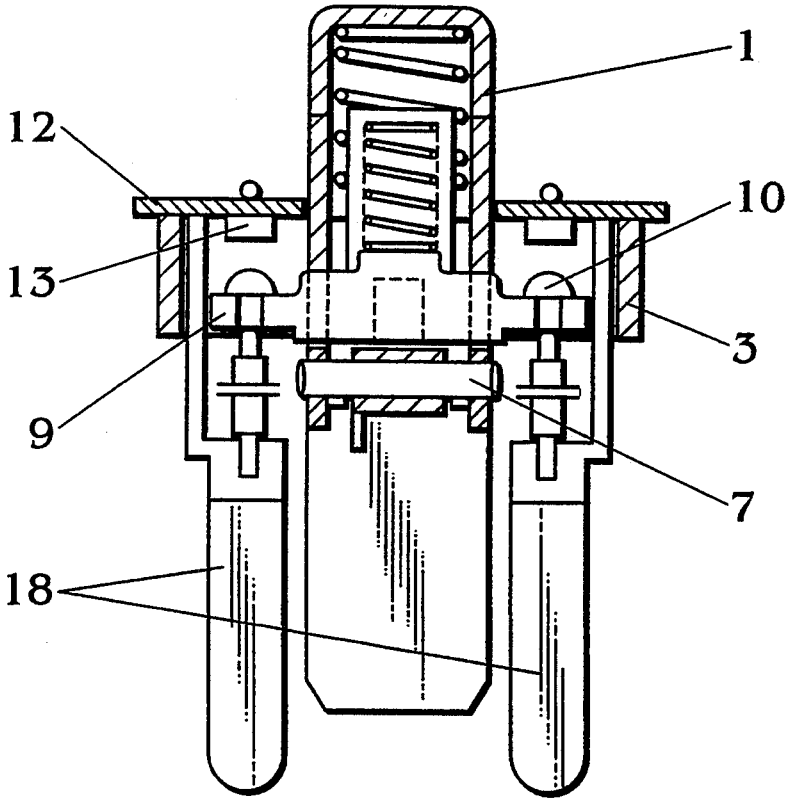
FIG. 4 shows a cross section through the device (according to FIG. 6) in the zone of the switch contact arrangement.
Figure 6:
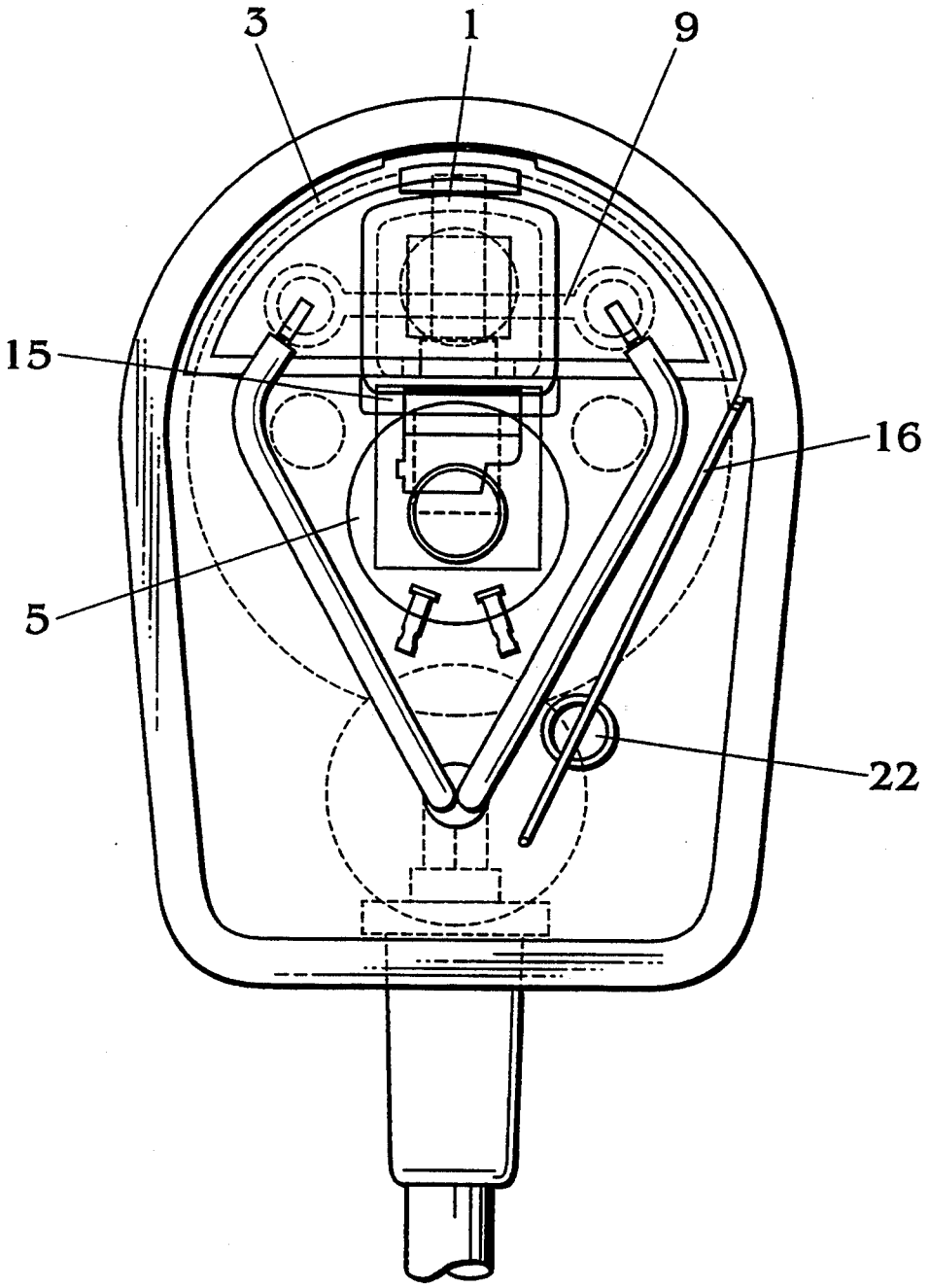
FIG. 6 is a top view of the opened device in a simplified representation.

Concerning the arrangement of the constructional parts—which are organized as switching mechanics and monitoring electronics—within the angle plug selected in the present case as the exemplified embodiment in terms of their installation. The switching mechanics inserted in the open plug casing 17 from the top, by means of its casing part 3, slides form-locking into the top part of the plug casing 17, and with that extends with the magnet yoke of the exciting coil 5—which is rigidly mounted on the casing part 3—of the plunger-type magnet system between the extended connection tags of the plug prongs 18—which grip through outwardly—down to the bottom of the (contoured) plug-in part on the plug casing 17. According to the representation in FIGS. 4 and 6 of the drawing, the circuit board 12 is connected to the connection cable 19 of the protective switching device, and the monitoring electronics supported by it. Circuit board 12 fits into the top part of the plug casing 17 and, in doing so, gets to be placed with the fixed contact pieces 13 exactly on top of the movable contact pieces 10 of the switch track on both sides of the control handle 1, which is free-standing upwardly. Auxiliary contact arrangement 15 (according to FIG. 5) are located on top of the lever arm of the coupling element 4, with the lever arm being provided with a switching cam 20 for said arrangement, in the direction of the plunger-type magnet system. For securing the circuit board 12, it is soldered with the connections of the exciting coil 5 gripping through contact bores, and with the connection tags of the plug prongs 18. Subsequently, the completely mounted protective switching device can be closed with a covering cap 21 gripping across the edge of the opening of the plug casing 17 and interlocking with said edge. The covering cap, on the face side, being gripped through by the control handle 1 and a press key 22 acting on the test contact arrangement 16 on the top side of the circuit board 12.

Figure 2:
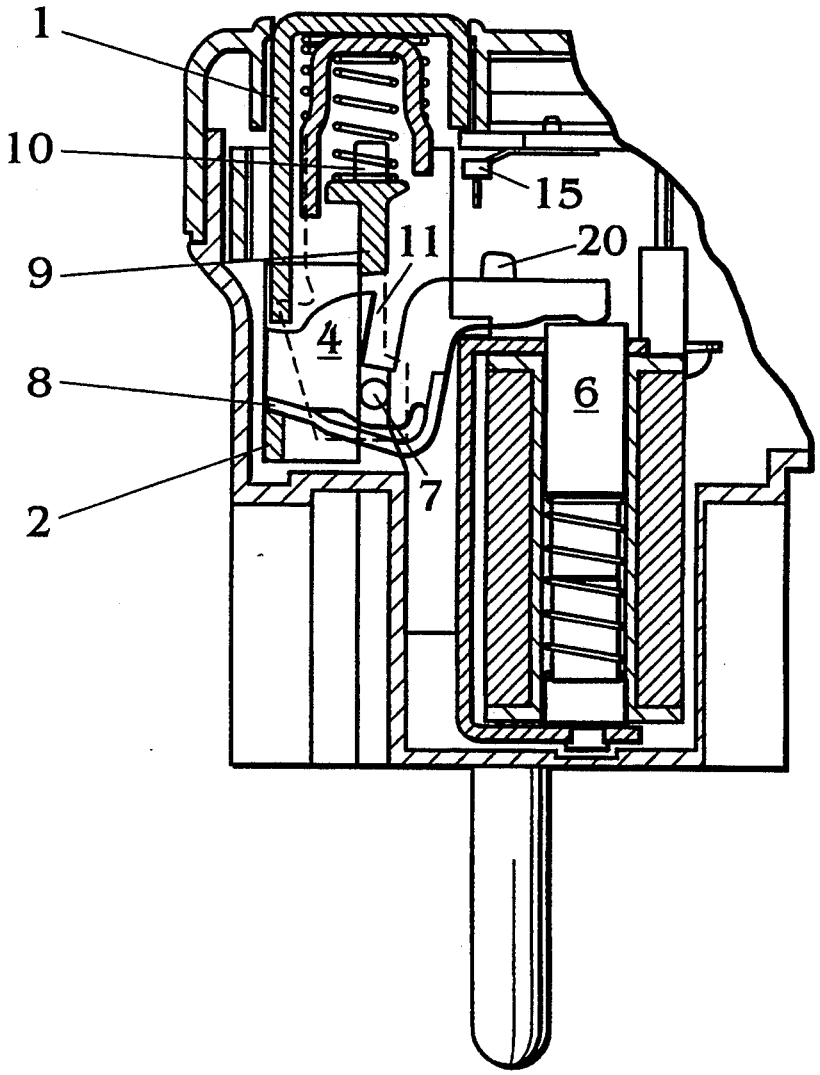

The protective switching device is ready for switching for the connected consumer product after it has been plugged into a voltage-supplied socket. Upon manual pressure applied to the control handle 1, the latter adjusts the coupling element 4—which is swivel-mounted on said handle—in the direction of actuation, and thereby first closes the auxiliary contact arrangement 15 for the power supply of the monitoring electronics of the device. Thereafter, once the coupling element 4 has reached, with inclusion of the elasticity imparted by its stop bow 8, the fixed stop 2 on the casing part 3 of the switching mechanics, the coupling element 4, on further pressing down of the control handle 1, rotates around its bearing shaft 7 against the plunger-type magnet 6 into the interior of the exciting coil 5, so that magnet 6 moves against a plunger spring and contacts the rigidly installed magnet core (as shown in FIG. 2).

With the release of the control handle 1 and any error present in the fixed installation, for example in the form of a conductor interruption, the afore-described sequence simply reverses, Accordingly, the plunger 6, under the pressure of its plunger spring, immediately swivels the coupling element 4—which returns with the independently recoiling control handle 1 to the starting position—into its stop-free position, and in this way prevents it from interlocking with the contact support part 9. Thereafter, upon reaching the final position, the coupling element 4 breaks the auxiliary contact arrangement 15, and cuts off the monitoring electronics off the power supply network.

Figure 3:
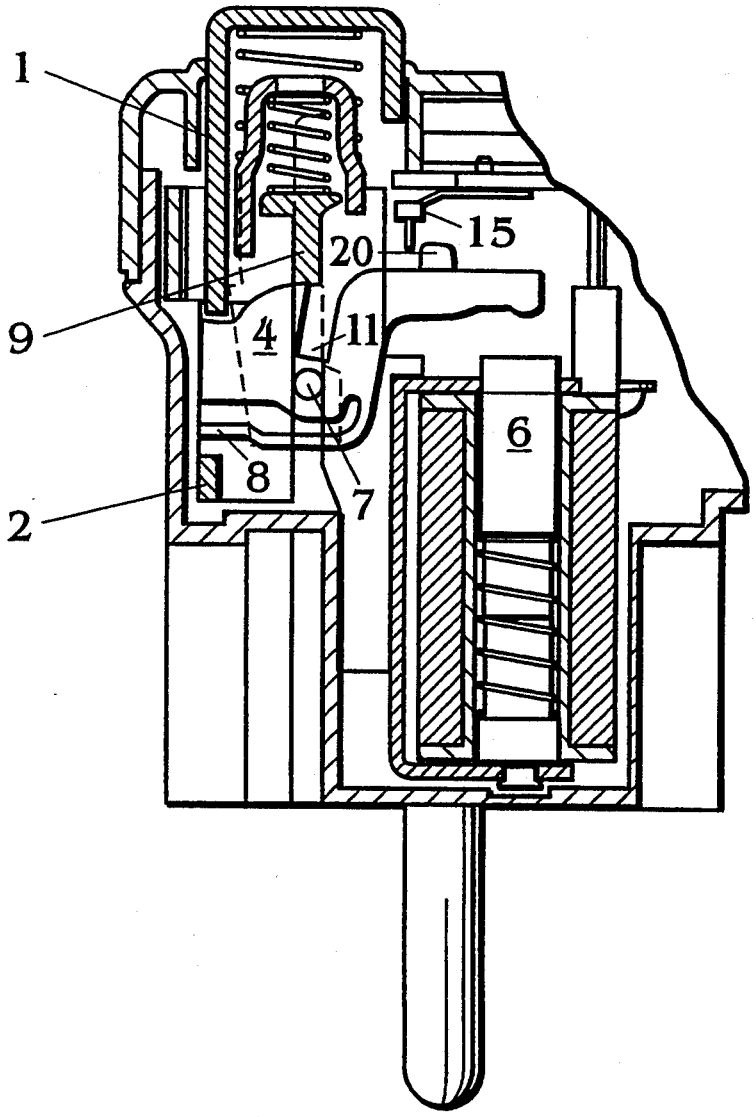
FIG. 3 is the same representation (according to FIG. 2) in the switch-on position.

If the equipment is operating properly, however, the exciting coil 5 is supplied with voltage via the auxiliary contact arrangement 15, so that its plunger 6 remains attracted. In this way, on release of the control handle 1, first the springing of the coupling element 4 due to its stop bow 8 comes into action. Coupling element 4 is swivelled in the interlocking position with the contact support part 9, so that the latter is carried along by the higher spring-loaded control handle 1 against the force of the weaker contact opening spring until its two contact pieces 10 impact the fixed contact pieces 13 on the underside of the circuit board 12, (as shown in FIG. 3). The protective switching device is switched on and ready for operation for the consumer product connected via the cable 19.

In case of error, the electronic circuit arrangement supported by the circuit board 12 is activated via the summation transformer 14 by a part current flowing off to ground in an impermissible quantity, by which activation the power supply of the exciting coil 5 of the plunger system is interrupted and the interlocking between the coupling element 4 and the contact support part 9 (as shown in FIG. 3) is knocked open by said system. As a result, the contact opening spring forces the contact support part 9 again into the recess 11 of the curved profile on the sides of the coupling element 4 and opens thereby the switch contact path 10/13, whereas the control handle 1 counter-currently returns to the switch-off position.

For switching the protective switching device off, it suffices to simply pull the latter with its two plug prongs 18 from the mains socket, or to only briefly actuate the test key 22, simulating in this way a leakage current, which causes the protective switching device to trip as with a defect, and which upon elimination of the defect requires the device to be switched on again.

Furthermore, the embodiment of the protective switching device proposed herein by way of example can be equipped also, if need be, with a 3-pole connection and round or flat prongs of another plug connection system instead of the 2-pole connection.

What is claimed is:

1. A protective switching device disposed within a housing having a stop adapted for current interruption responsive to difference-current and/or undervoltage, the device comprising:

a spring-loaded tripping element;

means for controlling said spring-loaded tripping element;

contact means for selectively allowing current flow through the device;

a pivotal coupling element having an abutment surface, said pivotal coupling element and said contact means being in spring-loaded engagement with each other; and a control button for pivoting said coupling element against said tripping element to (i) set said tripping element and (ii) place said abutment surface against said contact means to allow current flow;

whereby at least one of a difference-current and an undervoltage detected by said controlling means releases said tripping element and pivots said coupling element against the housing stop, whereby said contact means slides off said abutment surface and terminates current flow.

2. The device according to claim 1, additionally comprising:

a spring for biasing said control button away from the housing, said control button having extensions;

an axle supported on said extensions; and wherein said coupling element pivots about said axle.

3. The device according to claim 1, wherein said coupling element includes (i) an elastic stop bow integrally molded thereon and facing the stop; and (ii) a recess shaped to accommodate said contact means therein when said contact means slides off the abutment surface.

4. The device according to claim 1, wherein the housing supports said tripping element laterally beneath said coupling element and said device is a single constructional assembly.

5. The device according to claim 1, wherein said contact means comprises:

(i) fixed contacts for allowing current flow through said device;

(ii) auxiliary contacts for powering said device; and (iii) test key contacts for testing said device;

said device further including a printed circuit board for contacting said contacts, said circuit board including electronic monitoring means and being mechanically and electrically coupled with said tripping element.

6. The device according to claim 1, further comprising a test button and wherein said housing is formed as a connecting plug and includes a cover with said control button and the test button extending therethrough in spaced relation to each other.

7. The device according to claim 1, further comprising a test button and wherein said housing is formed as a switch and includes a cover with said control button and the test button extending therethrough in spaced relation to each other.

8. The device according to claim 1, wherein said housing is formed as a connecting plug having plug prongs; and said device further including a circuit board disposed within the housing above said tripping element, said circuit board being supported by a section of the plug prongs.

9. A protective switching device disposed within a housing adapted for current interruption responsive to difference-current and/or undervoltage, the housing having a stop thereon, the device comprising:

a spring-loaded tripping element;

a summation transformer for controlling said spring-loaded tripping element;

contact means for selectively allowing current flow through said device;

an axle;

a coupling element pivotally mounted on the axle, said coupling element being spring-loaded in a direction toward said contact means and having an abutment surface, said coupling element further including an elastic stop bow integrally molded thereon and facing the housing stop, said coupling element also including a recess shaped for accommodating said contact means;

a control button for pivoting said coupling element against said tripping element to (i) set said tripping element; and (ii) place the abutment surface against said contact means to allow current flow, said control button having extensions and said axle being supported on the extensions; and a spring for biasing said control button away from said housing, whereby at least one of a difference-current and an undervoltage detected by said summation transformer releases said tripping element and pivots said coupling element against said stop and whereby said contact means slides off said abutment surface into the recess and terminates current flow.

10. The device according to claim 1, wherein said means for controlling said spring loaded tripping element is a summation transformer.

* * * * *